US006179759B1

(12) United States Patent
Tellone

(10) Patent No.: US 6,179,759 B1
(45) Date of Patent: Jan. 30, 2001

(54) PORTABLE COLLAPSIBLE AQUATIC ABDOMINAL EXERCISE APPARATUS

(76) Inventor: Richard A. Tellone, 6530-1 Cape Hatteras, NE., St. Petersburg, FL (US) 33702

( * ) Notice: Under 35 U.S.C. 154(b), the term of this patent shall be extended for 0 days.

(21) Appl. No.: 09/406,295

(22) Filed: Sep. 24, 1999

(51) Int. Cl.[7] ..... A63B 21/008
(52) U.S. Cl. ..... 482/111; 482/55
(58) Field of Search ..... 482/111, 114, 482/131, 133, 35–38, 51, 54, 55, 140, 141; D21/678, 685; 182/93, 120

(56) References Cited

U.S. PATENT DOCUMENTS 4,789,152 * 12/1988 Guerra ..... 482/142
5,033,735 * 7/1991 Erickson ..... 482/39
5,080,352 * 1/1992 Freed ..... 482/140
5,234,391 * 8/1993 Shasek et al. ..... 482/111

* cited by examiner

*Primary Examiner*—Justine R. Yu
(74) *Attorney, Agent, or Firm*—Louis J. Brunoforte

(57) ABSTRACT

A portable and collapsible aquatic abdominal exercising apparatus for use in a pool is provided. The apparatus includes first and second downwardly extending parallel leg members, first and second arm-rest extensions and first and second pool-deck supports. Each of these elements can be provided with telescopic capabilities. A single support rod extends between the two leg members and additionally supports a back-rest. A pair of four-way coupling units work to attach all of the elements together. The legs can move freely along two axis adding to its portability and collapsibility. The device sits freely in a pool and supports the weight of a user as the user rests their back against the back-rest, positions their forearms on the arm-rest extensions, grasps a pair of hand grips and repetitively moves their body upwardly to strengthen the abdominal muscles.

20 Claims, 8 Drawing Sheets

PORTABLE COLLAPSIBLE AQUATIC ABDOMINAL EXERCISE APPARATUS

BACKGROUND OF THE INVENTION

1. Field of the Invention

This invention relates to an exercise apparatus for use in a body of water. More particularly, it relates to a portable aquatic exercise apparatus used for strengthening abdominal muscles which mounts on the edge of a pool such that a person is supported in the pool by the apparatus while exercising, the apparatus capable of collapsing into a convenient size for easy transportation and storage when not in use.

2. Description of the Prior Art

Aquatic exercise devices used to strengthen muscles are known in the prior art. For instance, U.S. Pat. No. 5,033,735 to Erickson shows an aquatic exercise device removably attachable to a pool ladder or, in an alternate embodiment, permanently attachable to a pool deck. The device can be used to perform a bevy of different exercise routines including chin-ups, sit-ups, leg butterflys and leg kicking. Unfortunately, the Erickson device requires either exclusive use of the pool ladder or permanent pool deck attachment means to affect use thereof. If the ladder of the pool is needed, the Erickson device must be removed. Attempts at climbing the ladder with the device attached thereto could result in injury. An alternate embodiment of Erickson attempts to alleviate this problem by providing for permanent attachment to the pool deck. Unfortunately, not all pool owners want a device permanently affixed to the deck of their pool. Besides detracting from the aesthetic appearance of the pool, the permanently mounted device could cause injury if tripped upon. An improved aquatic exercising device is needed which can overcome the deficiencies seen in the prior art. Such a device should be portable, should not require the use of a ladder or other means of attachment and should further provide for easy transportation and storage thereof when not in use.

SUMMARY OF THE INVENTION

I have invented an improved aquatic exercising apparatus which can be used to strengthen abdominal muscles. My apparatus does not require a permanent means of attachment nor the use of other pool accessories (i.e., ladder or steps) for affecting the use thereof. My apparatus conveniently rests upon the side and deck of the pool. Further, my apparatus is lightweight, portable and collapsible, providing for easy transportation and storage.

The apparatus includes a pair of downwardly extending legs which parallel the side of the pool when the apparatus is set therein. A pair of inwardly extending feet are positioned on a lower end of the pair of legs for resting upon the side of the pool. Positioned at a middle portion of the pair of legs are a pair of couplers to which a pair of four-way coupling units are mounted. Each four-way coupler has four openings formed therein. Two of the openings, which are axial alignment of one another retain the coupler in a fixed position. A third opening of each coupler receives one of a pair of outwardly extending arm-rests. A fourth opening of each coupler receives one end of a back-rest support rod. A pair of deck-resting members, integrally attached to an upper end of each leg at a ninety degree therefrom, work in conjunction with the pair of feet to position the apparatus in a fixed position along the side of the pool. A back rest, in parallel relationship with the side of the pool, is supported by the back rest support rod.

The arm-rest extensions are removable and the legs are pivotable within the coupler providing a means to collapse the apparatus (see FIG. 2). The arm-rests, the deck-resting members and the legs are telescopic permitting the apparatus to be adjusted for a variety of different people and configuration of pools.

BRIEF DESCRIPTION OF THE DRAWINGS

The invention may be best understood by those having ordinary skill in the art by reference to the following detailed description when considered in connection with the accompanying drawings in which.

DETAILED DESCRIPTION OF THE INVENTION

Figure 1:
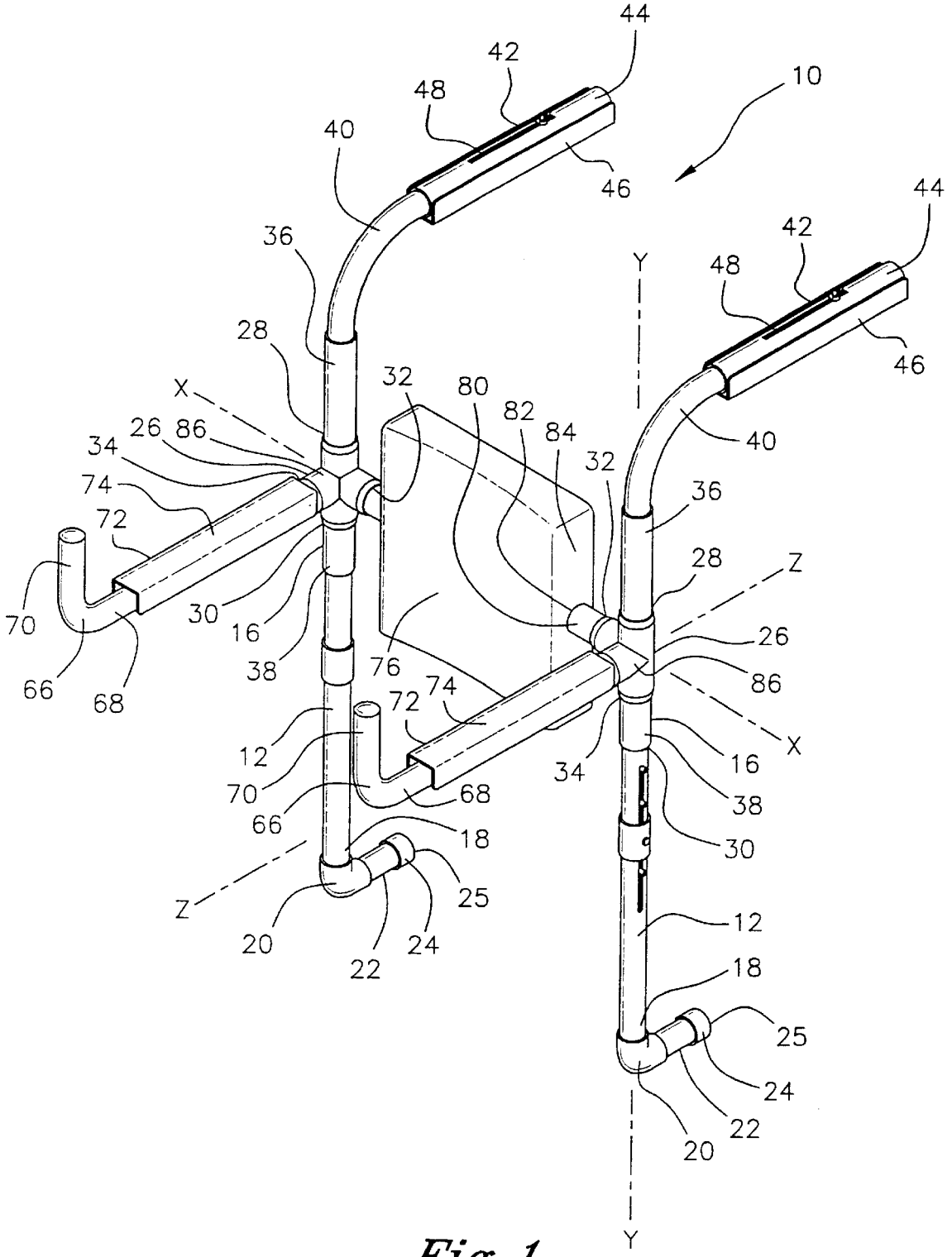
FIG. 1 is a perspective view of an aquatic exercising apparatus of the present invention.

Throughout the following description, the same reference numerals refer to the same elements in all figures.

Figure 2:
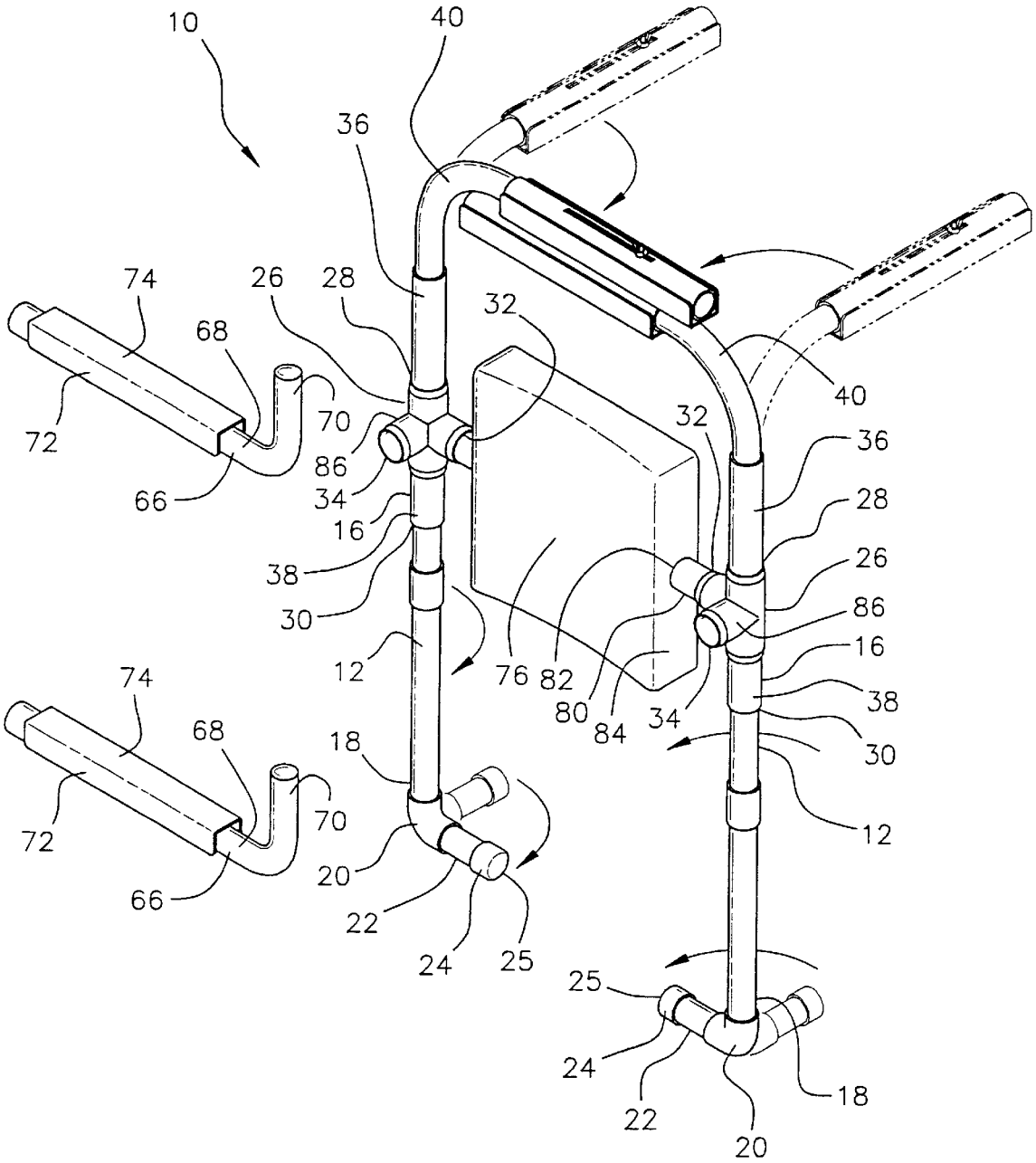
FIG. 2 is a perspective view of the aquatic exercising apparatus of the present invention illustrating the novel portable and collapsible nature of the apparatus.

Referring to FIG. 1, an aquatic abdominal exercising apparatus 10 of the present invention is shown. Apparatus 10 is preferably made of lightweight PVC providing for ease of portability. As shown in FIG. 2, apparatus 10 is also collapsible adding to its portability as well as providing for ease of storage.

With continuing reference to FIG. 1, aquatic exercising apparatus 10 is shown to include a pair of downwardly extending legs 12 positioned in parallel relationship to one another. At a middle portion of each leg 12 is a coupler 16 in which leg 12 inserts through. At a lower end 18 of each leg 12 is an elbow connector 20. Extending from each elbow connector 20 is a foot 22 having a cap 24 portioned over a terminus end 25. Each foot 22 is generally positioned at a ninety degree angle from each leg 12 and extends inwardly from a front side of apparatus 10. Cap 24 is preferably made of a hard rubber material for resting on a side of a pool.

As shown in FIG. 2, legs 12 oppositely pivot ninety degrees inwardly such that feet 22 face one another, thereby contributing to the collapsibility of apparatus 10. The ability of each leg 12 to pivot is a result from the diameter of an outer circumference of each leg 12 being measurably less than the diameter of an inner circumference of each coupler 16. Although not shown, a pair of stop members could be provided between each coupler 16 and each leg 12 so that legs 12 lock into two respective positions—that which is shown in FIG. 1 (the position for use) and that which is shown in FIG. 2 (the collapsed position).

With reference to FIG. 1, aquatic exercising apparatus 10 further includes a pair of four-way coupling units 26 having four openings formed therein and providing an X axis, a Y axis, and a Z axis. A first and second opening, 28 and 30 respectively, are in axial alignment with one another along the Y axis. A third opening 32 is positioned at a ninety degree angle from first and second openings, 28 and 30 respectively, along the X axis. A fourth opening 34 is positioned at a ninety degree angle from first, second and third openings, 28, 30 and 32 respectively, along the Z axis. Couplers 16 inserts through the four-way coupling unit first and second openings, 28 and 30 respectively, such that each coupler 16 exposes a top and bottom portion, 36 and 38 respectively. Coupler 16 is retained in a fixed position by friction; accordingly, the diameter of an outer circumference of coupler 16 is slightly less than that of an inner circumference of four-way coupling unit 26.

Figure 5:
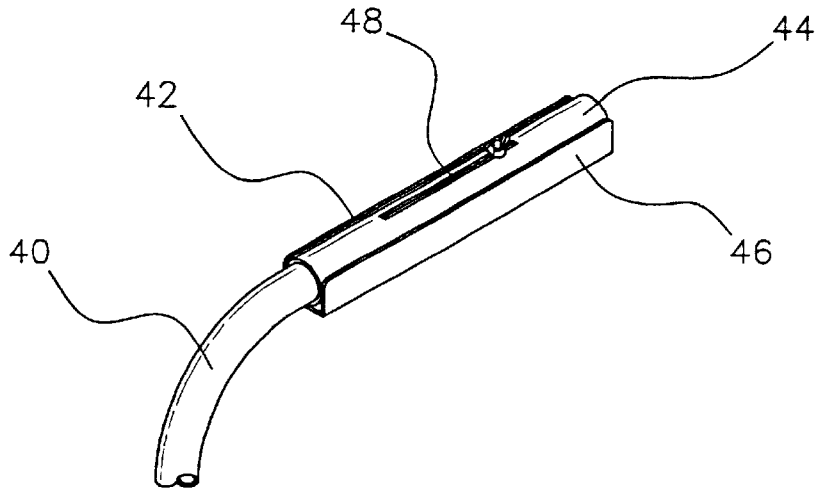
FIG. 5 is a perspective view of a preferred telescopic deck-resting member of the aquatic exercising apparatus of the present invention; the preferred telescopic deck-resting member in a non-extended state.
Figure 6:
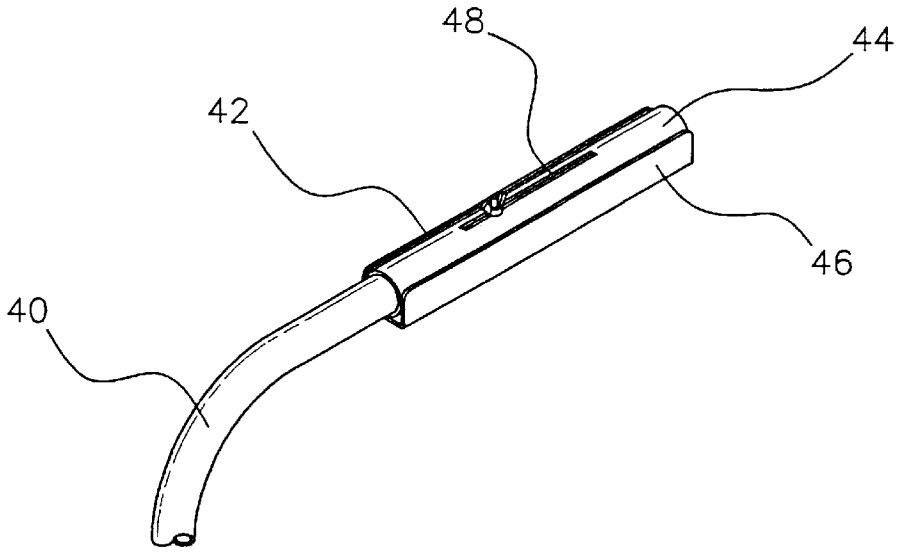
FIG. 6 is a perspective view of the preferred telescopic deck-resting member of the aquatic exercising apparatus of the present invention; the preferred telescopic deck-resting member in an extended state.

With continuing reference to FIG. 1, each leg 12 has an upper curved end 40 extending in the same direction as that of elbow connectors 20 and feet 22. In the preferred embodiment, upper curved end 40 is integral with leg 12, although an alternate embodiment (not shown) could employs elbow connectors. Apparatus 10 is further provided with a pair of deck-resting members 42, each having a tubular portion 44, inserted over upper curved end 40, and a seat 46, in which tubular member 44 rests within. Tubular member 44 and seat 46 are fixedly attached, preferably by glue. Seat 46 resembles a three sided square wherein a flat bottom side lays upon the pool deck when apparatus 10 is employed in the pool. Telescopic means are further provided permitting a user of apparatus 10 to adjust the position of deck-resting members 42 (see FIGS. 5 and 6). In accordance therewith, a slit 48 is formed along a top side of tubular member 44. A threaded aperture (not shown) is formed in upper curved end 40 along the portion which is inserted within tubular member 44. The threaded aperture is axially aligned with slit 48. A screw inserts through slit 48 and into the threaded aperture; a wing nut is used to lock the telescopic deck-resting member in the desired position. As shown in FIG. 5, deck-resting member is in a non-extended state, whereas FIG. 6 illustrates an extended position.

Figure 7:
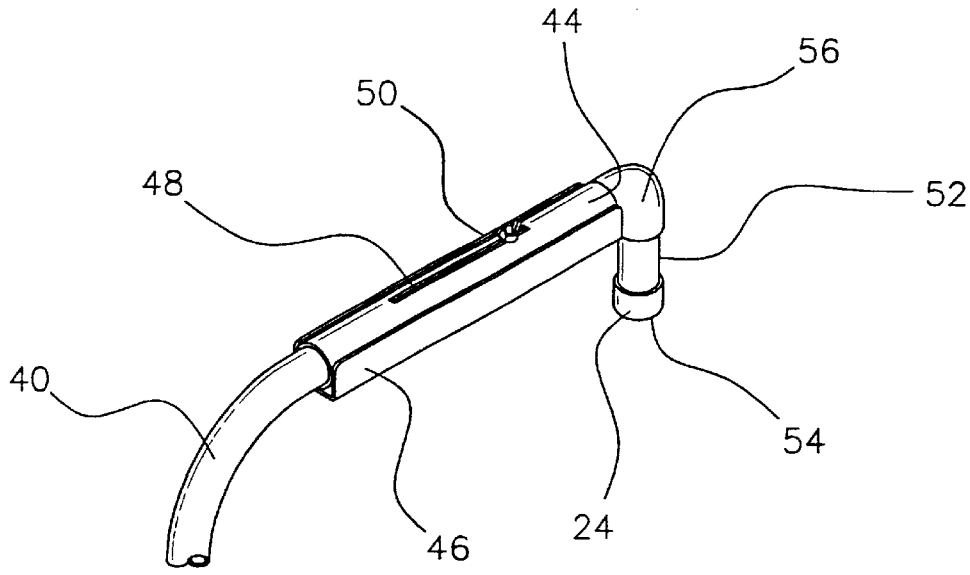
FIG. 7 is a perspective view of a first alternate telescopic deck-resting member of the aquatic exercising apparatus of the present invention; the first alternate telescopic deck-resting member in a non-extended state.
Figure 8:
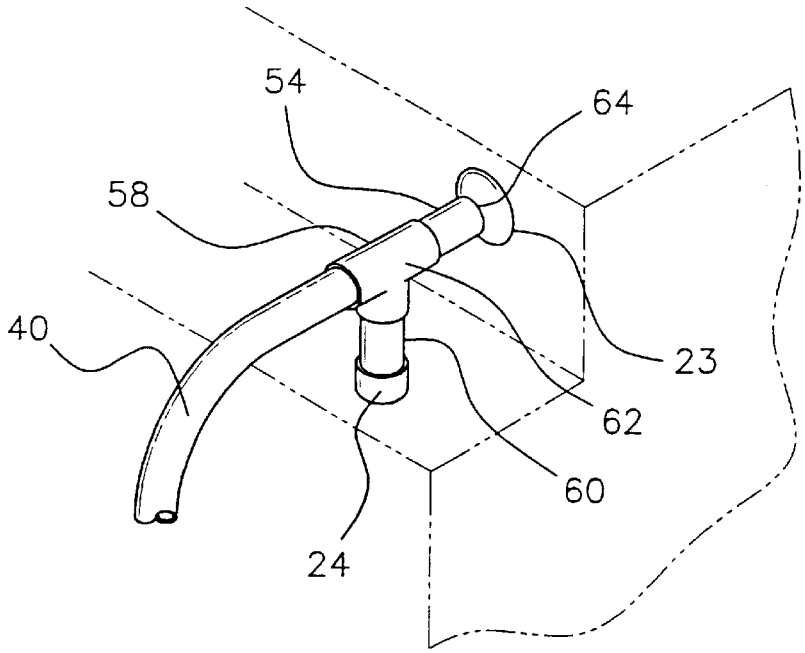
FIG. 8 is a perspective view of a second alternate non-telescopic deck-resting member of the aquatic exercising apparatus of the present invention.

Although FIGS. 1, 2, 5 and 6 illustrate the preferred embodiment for deck-resting members 42, alternate embodiments are provided. In particular, FIG. 7, illustrates a first alternate deck-resting member 50 wherein a downwardly extending deck foot 52 is provided along a distal end 54 of upper curved end 40. Foot 52 can be attached by an elbow connector 56 or be integral with upper curved end 40 (not shown). FIG. 8, illustrates a second alternate deck-resting member 58 wherein a first downwardly extending canal foot 60 is attached near a distal end 54 of upper curved end 40 by a t-connector 62. A second outwardly extending canal foot 64 extends from upper curved end 40 along the same axis thereof. In both alternate embodiments, all of the feet are either provided with caps 24 or suction cups 23. Caps 24 are made of a hard rubber whereas suction cups 23 are made of soft rubber. The alternate embodiments of FIGS. 7 and 8 are used with pools having a different configurations than that of the pool in which the preferred embodiment is used. In particular, first alternate deck-resting member 50 is used with pools wherein an overflow canal is provided proximal to the pool edge. And, second alternate deck-resting member 58 is used with pools wherein an overflow canal is provided directly below the pool edge. Finally, it is noted that first alternate deck-resting member 50 is provided with the same telescopic means as preferred deck-resting member 42. Although second alternate deck-resting 58 does not show the telescopic means, such could be provided if desired.

Referring to FIG. 1, aquatic exercising apparatus 10 further includes a pair of arm-rest extensions 66. Each extension 66 is positioned along the Z axis and removably inserts within fourth opening 34 of four-way coupling unit 26. Each arm-rest extension 66 includes a tubular portion 68 having an upwardly extending curved end 70, a tubular collar 71 (see FIG. 3 and 4) inserted over an opposed straight end of tubular portion 68 and further inserted within fourth opening 34 and a three-sided square sleeve 72 attached to tubular collar 71. Sleeve 72 in fixedly attached to tubular collar 71, preferably by glue. Tubular collar 71 is held by friction within fourth opening 34. A flat top side 74 of sleeve 72 permits a user of apparatus 10 to rest their arms thereupon. Upwardly curved end 70 acts as a hand-grip for the user. Also shown in FIG. 1, is a back rest 76 having a slightly concave front side 78. A support rod 80 inserts through apertures 82 formed in side portions 84 of back rest 76 and attaches to apparatus 10 at opposed ends by friction in the pair of four-way coupling unit third openings 32 along the X axis.

As shown in FIG. 2, each arm-rest extension 66 can be removed from its associated four-way coupling unit fourth opening 34. This adds to the collapsibility and portability of aquatic exercising apparatus 10. Although not shown, a small pin can be used to hold each arm-rest extension 66 in place when attached to apparatus 10 (as in FIG. 1). Preferably, the pin is inserted through an aperture formed in a collar portion 86 of each fourth opening 34; an aperture formed in the inserted end of tubular collar 71 would then axially align with the collar aperture.

Figure 3:
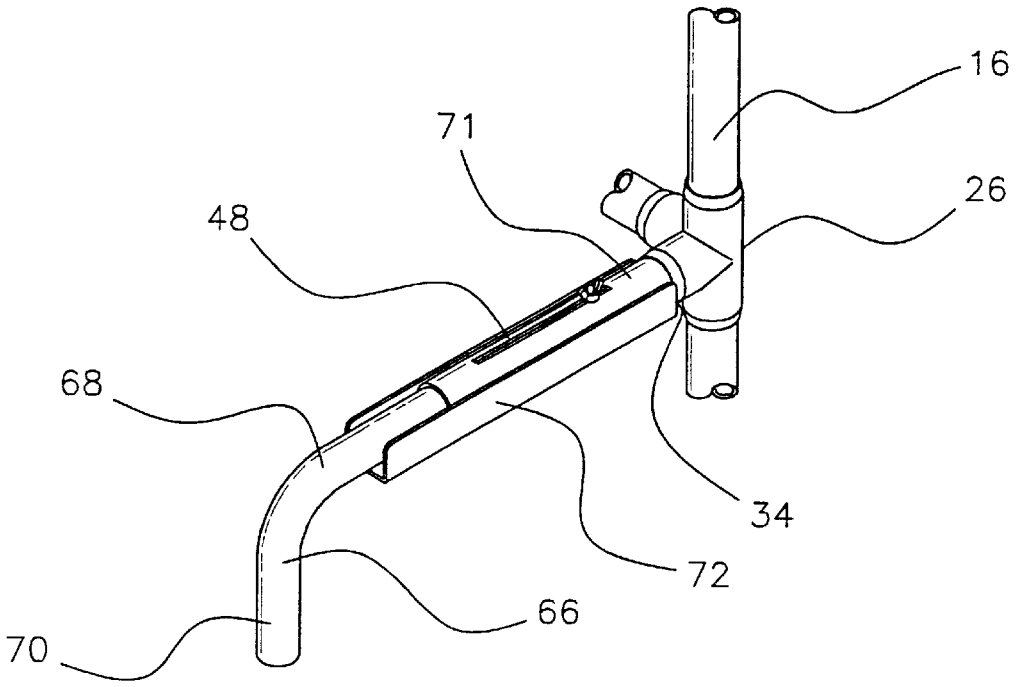
FIG. 3 is a perspective view of a bottom side of a telescopic arm-rest extension of the aquatic exercising apparatus of the present invention; the telescopic arm-rest extension in a non-extended state.
Figure 4:
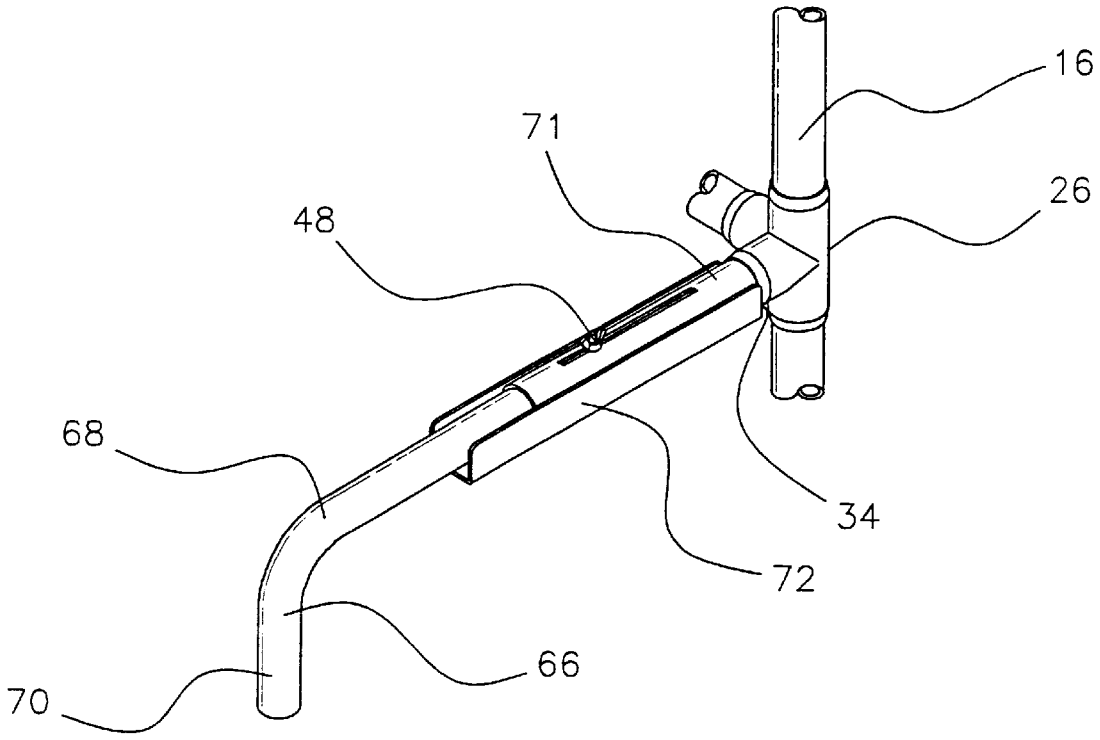
FIG. 4 is a perspective view of the bottom side of the telescopic arm-rest extension of the aquatic exercising apparatus of the present invention; the telescopic arm-rest extension in an extended state.

Referring to FIGS. 3 and 4, a bottom perspective view of a preferred arm-rest extension 66 is shown illustrating the telescopic means provided therewith. Such telescopic means works identically like that of deck-resting members 42. As such, a slit 48 is formed along a portion of arm-rest extension tubular collar 71 and axially aligns with a threaded aperture (not shown) in tubular portion 68. A screw inserts through slit 48 and into the threaded aperture; a wing nut is used to lock the telescopic arm-resting extensions 66 in the desired position. As shown in FIG. 3, arm-resting extension 66 is in a non-extended state, whereas FIG. 4 illustrates an extended position.

Figure 9:
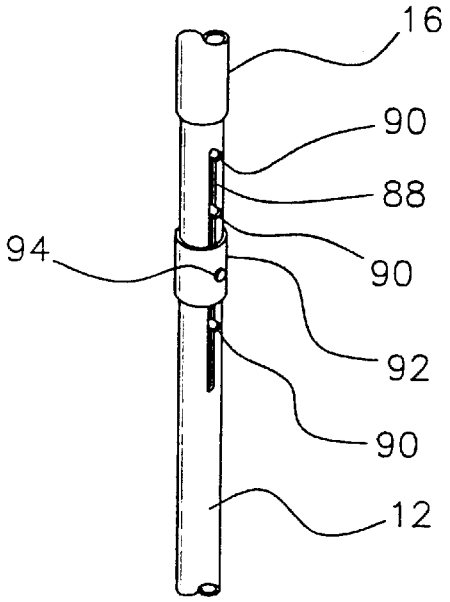
FIG. 9 is a perspective view of a preferred downwardly extending telescopic leg of the aquatic exercising apparatus of the present invention; the preferred telescopic leg in a partially extended state.
Figure 10:
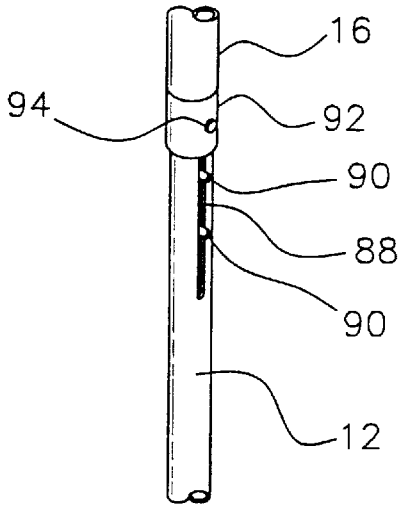
FIG. 10 is a perspective view of the preferred downwardly extending telescopic leg of the aquatic exercising apparatus of the present invention; the preferred telescopic leg in a non-extended state.
Figure 11:
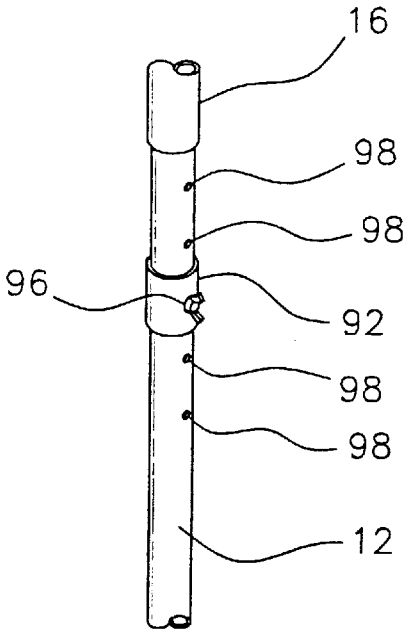
FIG. 11 is a perspective view of an alternate downwardly extending telescopic leg of the aquatic exercising apparatus of the present invention; the alternate telescopic leg in a partially extended state.
Figure 12:
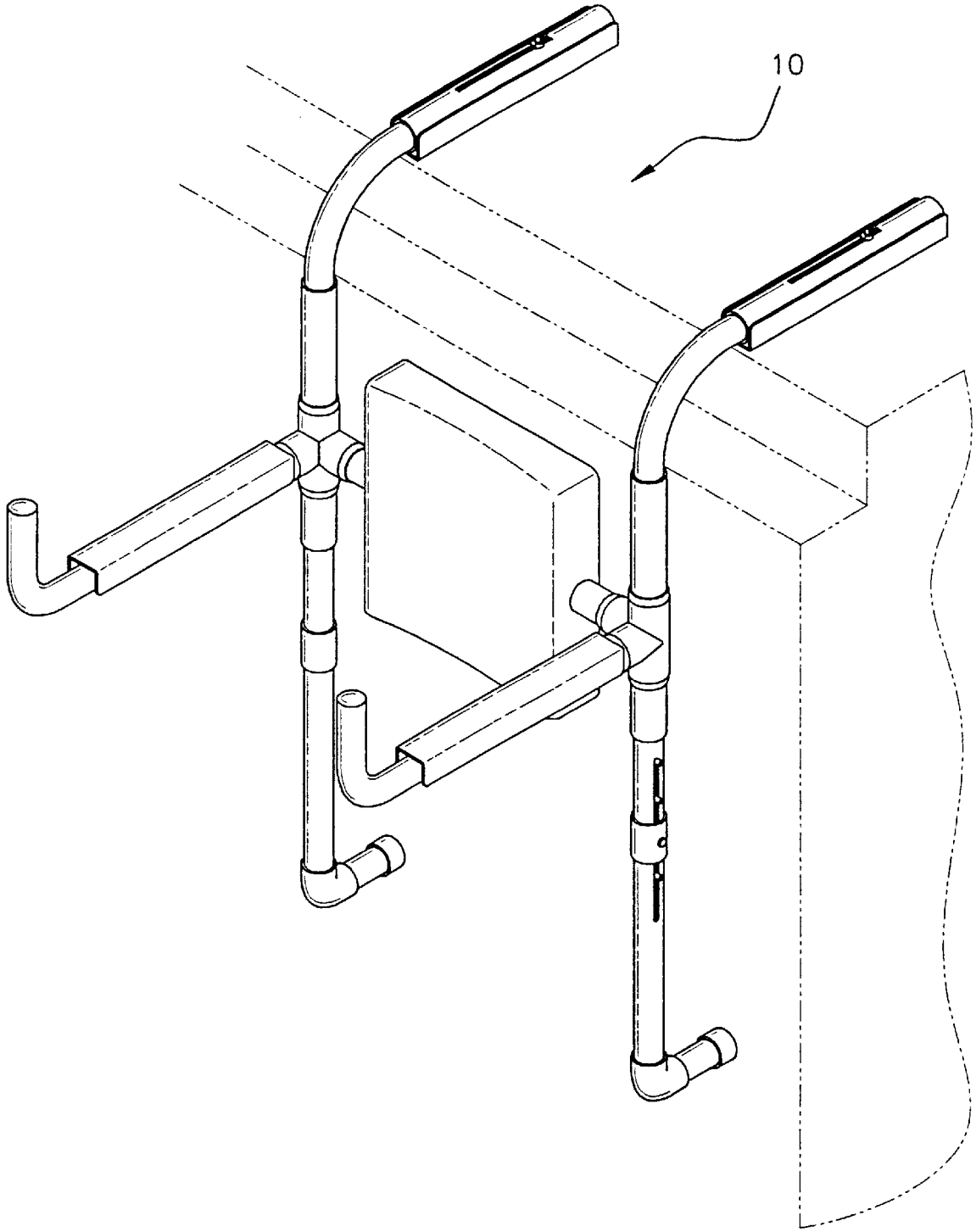
FIG. 12 is a perspective view of the preferred aquatic exercising apparatus of the present invention depicting how it is employed along the side of a swimming pool.

Legs 12 are also provided with telescopic means for adjusting aquatic exercising apparatus 10 in a user desired position. FIGS. 9 and 10 illustrate a preferred telescopic means for legs 12 whereas FIG. 11 illustrates an alternate telescopic means. With reference to FIGS. 9 and 10, each leg 12 has a slotted channel 88 formed therein. In the preferred embodiment, slotted channel 88 has four slots 90 thereby providing five different positions (the four slots plus the bottom end position). Each leg 12 further includes a slidable collar 92 having an aperture formed therethrough and a pin 94 inserted with the aperture. Collar 92 slides along channel 88 until the desired slot 90 is located whereby pin 94 is permitted to fall within, thereby retaining leg 12 in a fixed position by the force of gravity. As such, FIG. 10 illustrates a non-extended state whereas FIG. 9 illustrates a partially extended state.

With reference to FIG. 11, an alternate telescopic means for leg 12 is shown. This alternate embodiment utilizes a series of apertures 98 formed in leg 12, the slidable collar 92 and a screw/wing nut set 96. In accordance therewith, the desired position in first chosen by sliding collar 92 over one of the five apertures. Thereafter, collar 92 is locked in place by inserting the screw through the chosen apertures and locking it down with the wing nut.

Figure 13:
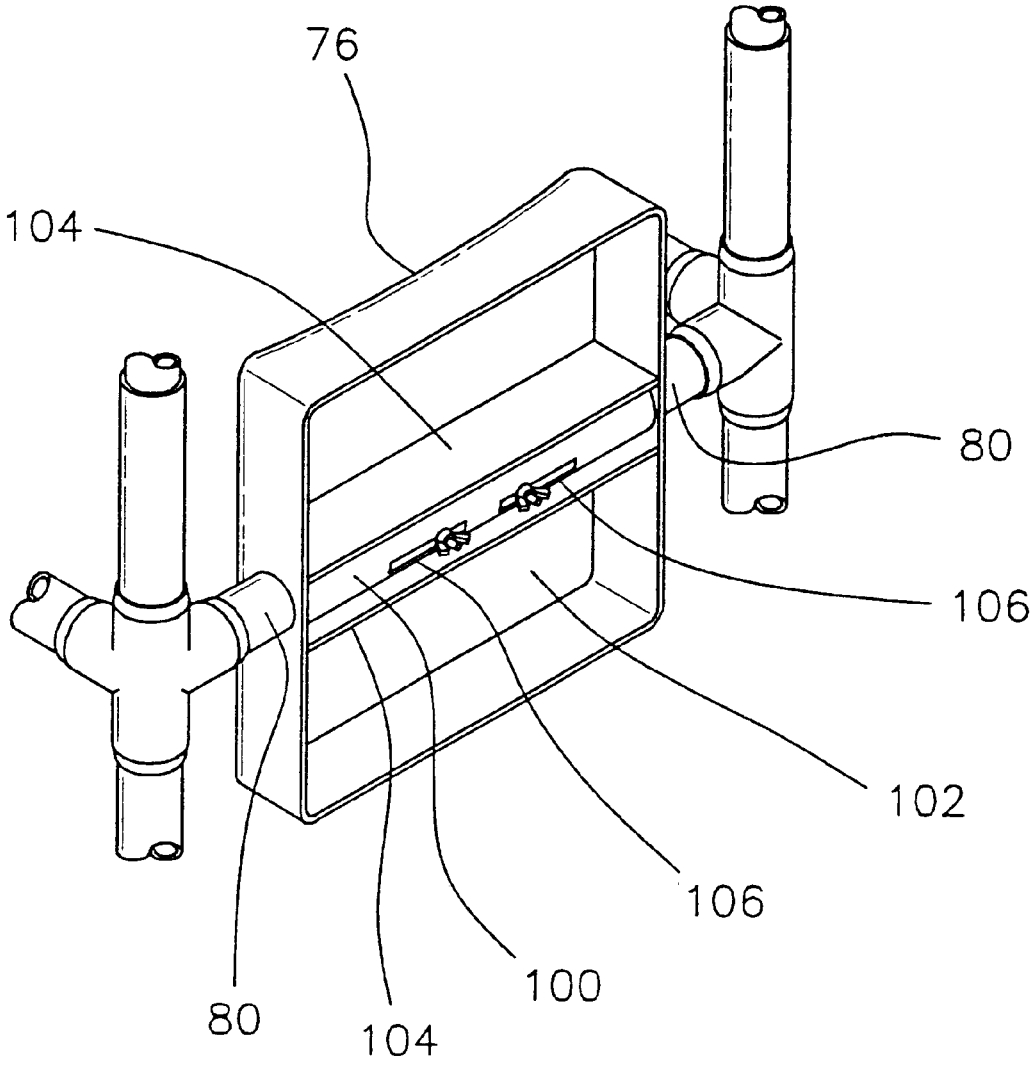
FIG. 13 is a rear perspective view of the back rest of the aquatic exercising apparatus depicting the telescopic feature of the support rod.

With reference to FIG. 13, a rear perspective view of back rest 76 illustrates that the width of apparatus 10 can be adjusted by telescopic means provided along support rod 80. In accordance therewith, a fixed collar member 100 is provided within a back area 102 of back rest 76 for receiving support rod 80. Collar member 100 is positioned between a pair of parallel walls 104 integrally formed to back area 102 of back rest 76. A pair of slits 106 are formed along collar member 100 and axially align with apertures (not shown) formed in support rod 80. A pair of wing nuts are used to position support rod 80 at the appropriate width.

In utilizing preferred aquatic exercising apparatus 10, the user first sets apparatus 10 in the pool such that the deck-resting members 42 lay upon the pool deck proximal to the pool edge. Feet 22 of legs 12 are allowed to come to rest upon the side of the pool underneath the water. It is presumed that the arm-rest extensions 66, the desk-resting members 42 and the legs 12 have all been set to the desired telescopic position. If not, each can be easily adjusted with apparatus 10 employed in the pool. The user then mounts apparatus 10 by placing their back against back rest 76, resting their forearms along arm-rest extension sleeve top side 74 and gripping upwardly extending curved ends 70 with their hands. Thereafter, using their abdominal muscles, the user gently and repetitively lifts the weight of their body upward.

Although not needed, the stability of aquatic exercising apparatus 10 can be enhanced by installing an attachment means to deck-resting members 42. For instance, hook and loop strips (i.e., Velcro®) could be employed along the flat bottom side of seat 46. Or, a series of screws could be inserted through seat 46 and into the pool deck.

Equivalent elements can be substituted for the elements employed in this invention to obtain substantially the same result in substantially the same way and function.

Having thus described the invention, what is claimed and desired to be secured by Letters Patent is:

1. A portable and collapsible aquatic abdominal muscle exercising apparatus for use in a pool, the apparatus having a portion submerged below the water surface of the pool, the apparatus comprising:

a) a pair of parallel leg members, each having a downwardly extending middle portion and an upper and lower curved end, both ends inwardly disposed at identical right angles from the middle portion, each upper end having a pool deck-resting support attached thereto, and each lower end having a foot member attached thereto, b) a pair of four-way coupling units each having four openings formed therein, a first and second opening of each coupling unit axially aligned providing a Y axis, a third opening of each coupling unit positioned at a right angle from its associated first and second opening forming an X axis such that each third opening of each coupling unit face one another and are axially aligned along the X axis, and a fourth opening of each coupling unit positioned at a different right angle from that of the first and second openings and that of the third opening providing a Z axis, c) a pair of leg couplers, each inserted through one of the coupling unit first and second openings, the pair of leg couplers receiving the pair of legs and permitting the legs to move freely along the Y axis and inwardly towards the X axis, d) a single support rod mounted between the pair of coupling unit third openings along the X axis, e) a back-rest support mounted on the support rod, and f) a pair of arm-rest extensions, each removably attached along its associated Z axis in the coupling unit fourth opening.

2. The portable and collapsible aquatic abdominal muscle exercising apparatus of claim 1, wherein each deck-resting support comprises a tubular portion inserted over the leg upper curved end and a seat member fixedly attached to the tubular portion, the seat member having a flat bottom side for resting upon a flat pool deck and a pair of opposed parallel side walls positioned at right angles from the flat bottom side.

3. The portable and collapsible aquatic abdominal muscle exercising apparatus of claim 2, further comprising first telescopic means for adjusting the position of the deck-resting support, the first telescopic means comprising a narrow slit formed in the tubular portion along a top side and having a length, a threaded aperture formed in the leg upper curved end axially aligned with the narrow slit, a screw inserted through the narrow slit and received by the threaded aperture, and a wing nut for engaging the screw and locking the deck-resting support anywhere along the length of the narrow slit.

4. The portable and collapsible aquatic abdominal muscle exercising apparatus of claim 1, wherein the leg upper curved end has a length longer than that of leg lower curved end.

5. The portable and collapsible aquatic abdominal muscle exercising apparatus of claim 4, wherein the foot is attached to the leg lower curved end by an elbow connector, the foot having a cap inserted over a terminus end, the cap resting upon a side surface of the pool below the water surface.

6. The portable and collapsible aquatic abdominal muscle exercising apparatus of claim 1, further comprising second telescopic means for adjusting the position of the parallel leg members, the second telescopic means comprising a channel formed in each leg below each four-way coupling unit, a plurality of slots in each channel, a pair of slidable collars and a pair of pins, each slidable collar moveable along the X axis, each pin inserted through one of the slidable collars for engaging any of the plurality of slots and for locking each collar in a fixed position such that each leg remains in a fixed position.

7. The portable and collapsible aquatic abdominal muscle exercising apparatus of claim 1, wherein the pair of leg couplers are fixedly attached to the four-way coupling units by friction.

8. The portable and collapsible aquatic abdominal muscle exercising apparatus of claim 1, wherein each arm-rest extension comprises a tubular member having an upwardly curved first end and a straight second end, a tubular collar inserted over the tubular member straight second end and a sleeve fixedly attached to the tubular collar, an end of the tubular collar distal from the tubular member upwardly curved first end inserted within the coupling unit fourth opening, the sleeve having a flat top side for supporting the forearms of a user of the apparatus, and the tubular member upwardly curved first end providing a hand grip for the user.

9. The portable and collapsible aquatic abdominal muscle exercising apparatus of claim 8, further comprising third telescopic means for adjusting the position of the arm-rest extensions, the third telescopic means comprising a narrow slit formed in the tubular collar along a bottom side and having a length, a threaded aperture formed in the tubular member straight second end axially aligned with the narrow slit, a screw inserted through the narrow slit and received by the threaded aperture, and a wing nut for engaging the screw and locking the arm-rest extension anywhere along the length of the narrow slit.

10. A portable and collapsible aquatic abdominal muscle exercising apparatus for use in a pool, the apparatus having a portion submerged below the water surface of the pool, the apparatus comprising:

a) a pair of parallel telescopic leg members, each having a downwardly extending middle portion and an upper and lower curved end, both ends inwardly disposed at identical right angles from the middle portion, each upper end integrally formed with the middle portion and having a pool deck-resting support attached thereto, each lower end having a foot member attached by an elbow connector, the upper end having a length longer than that of the lower end, b) a pair of four-way coupling units each having four openings formed therein, a first and second opening of each coupling unit axially aligned providing a Y axis, a third opening of each coupling unit positioned at a right angle from its associated first and second opening forming an X axis such that each third opening of each coupling unit face one another and are axially aligned along the X axis, and a fourth opening of each coupling unit positioned at a different right angle from that of the first and second openings and that of the third opening providing a Z axis, c) a pair of leg couplers, each inserted through one of the coupling unit first and second openings and fixedly retained by friction, the pair of leg couplers receiving the pair of legs and permitting the legs to move freely along the Y axis and inwardly towards the X axis, d) a single support rod mounted between the pair of coupling unit third openings along the X axis, e) a back-rest support mounted on the support rod and having a concave front side, and f) a pair of arm-rest extensions, each removably attached along its associated Z axis in the coupling unit fourth opening.

11. The portable and collapsible aquatic abdominal muscle exercising apparatus of claim 10, wherein each deck-resting support comprises a tubular portion inserted over the leg upper curved end and a seat member fixedly attached to the tubular portion, the seat member having a flat bottom side for resting upon a flat pool deck and a pair of opposed parallel side walls positioned at right angles from the flat bottom side.

12. The portable and collapsible aquatic abdominal muscle exercising apparatus of claim 11, further comprising a downwardly extending foot member attached to a terminus portion of the leg upper curved end by an elbow connector, the foot member having a cap inserted thereover, the downwardly extending foot member positioned in a parallel relationship with the leg downwardly extending middle portion.

13. The portable and collapsible aquatic abdominal muscle exercising apparatus of claim 10, wherein each deck-resting support comprises first and second foot members disposed at a right angle from one another and a t-connector, the first foot member extending downwardly from the leg upper curved end at a right angle, the second foot member extending along an axial line of the leg upper curved end, each of the first and second foot members having a cap inserted thereover.

14. The portable and collapsible aquatic abdominal muscle exercising apparatus of claim 10, wherein each arm-rest extension comprises a tubular member having an upwardly curved first end and a straight second end, a tubular collar inserted over the tubular member straight second end and a sleeve fixedly attached to the tubular collar, an end of the tubular collar distal from the tubular member upwardly curved first end inserted within the coupling unit fourth opening, the sleeve having a flat top side for supporting the forearms of a user of the apparatus, and the tubular member upwardly curved first end providing a hand grip for the user.

15. An adjustable, portable and collapsible aquatic abdominal muscle exercising apparatus for use in a pool, the apparatus having a portion submerged below the water surface of the pool, the apparatus comprising:

a) a pair of parallel leg members, each having a downwardly extending middle portion and an upper and lower curved end, both ends inwardly disposed at identical right angles from the middle portion, each upper end having a pool deck-resting support attached thereto, and each lower end having a foot member attached thereto, b) a pair of four-way coupling units each having four openings formed therein, a first and second opening of each coupling unit axially aligned providing a Y axis, a third opening of each coupling unit positioned at a right angle from its associated first and second opening forming an X axis such that each third opening of each coupling unit face one another and are axially aligned along the X axis, and a fourth opening of each coupling unit positioned at a different right angle from that of the first and second openings and that of the third opening providing a Z axis, c) a pair of leg couplers, each inserted through one of the coupling unit first and second openings, the pair of leg couplers receiving the pair of legs and permitting the legs to move freely along the Y axis and inwardly towards the X axis, d) a single support rod mounted between the pair of coupling unit third openings along the X axis, e) a back-rest support mounted on the support rod, f) a pair of arm-rest extensions, each removably attached along its associated Z axis in the coupling unit fourth opening, g) first telescopic means for adjusting the position of the deck-resting support, h) second telescopic means for adjusting the position of the parallel leg members, and i) third telescopic means for adjusting the position of the arm-rest extensions.

16. The adjustable, portable and collapsible aquatic abdominal muscle exercising apparatus of claim 15, wherein each deck-resting support comprises a tubular portion inserted over the leg upper curved end and a seat member fixedly attached to the tubular portion, the seat member having a flat bottom side for resting upon a flat pool deck and a pair of opposed parallel side walls positioned at right angles from the flat bottom side.

17. The adjustable, portable and collapsible aquatic abdominal muscle exercising apparatus of claim 16, wherein the first telescopic means comprises a narrow slit formed in the deck-resting support tubular portion along a top side and having a length, a threaded aperture formed in the leg upper curved end axially aligned with the narrow slit, a screw inserted through the narrow slit and received by the threaded aperture, and a wing nut for engaging the screw and locking the deck-resting support anywhere along the length of the narrow slit.

18. The adjustbale, portable and collapsible aquatic abdominal muscle exercising apparatus of claim 15, wherein the second telescopic means comprises a channel formed in each leg below each four-way coupling unit, a plurality of slots in each channel, a pair of slidable collars and a pair of pins, each slidable collar moveable along the X axis, each pin inserted through one of the slidable collars for engaging any of the plurality of slots and for locking each collar in a fixed position such that each leg remains in a fixed position.

19. The adjustable, portable and collapsible aquatic abdominal muscle exercising apparatus of claim 15, wherein each arm-rest extension comprises a tubular member having an upwardly curved first end and a straight second end, a tubular collar inserted over the tubular member straight second end and a sleeve fixedly attached to the tubular collar, an end of the tubular collar distal from the tubular member upwardly curved first end inserted within the coupling unit fourth opening, the sleeve having a flat top side for supporting the forearms of a user of the apparatus, and the tubular member upwardly curved first end providing a hand grip for the user.

20. The adjustable, portable and collapsible aquatic abdominal muscle exercising apparatus of claim 19, wherein the third telescopic means comprises a narrow slit formed in the arm-rest extension tubular collar along a bottom side and having a length, a threaded aperture formed in the arm-rest extension tubular member straight second end axially aligned with the narrow slit, a screw inserted through the narrow slit and received by the threaded aperture, and a wing nut for engaging the screw and locking the arm-rest extension anywhere along the length of the narrow slit.

* * * * *